United States Patent [19]

Rienecker et al.

[11] 4,396,160

[45] Aug. 2, 1983

[54] PULP DISSOLVER FOR THE PRODUCTION OF PULP SUSPENSIONS

[75] Inventors: Reimund Rienecker, Heidenheim-Mergelstetten; Walter Stricker, Aalen, both of Fed. Rep. of Germany

[73] Assignee: J.M. Voith GmbH, Heidenheim, Fed. Rep. of Germany

[21] Appl. No.: 282,765

[22] Filed: Jul. 13, 1981

[30] Foreign Application Priority Data

Jul. 18, 1980 [DE] Fed. Rep. of Germany ..... 3027215

[51] Int. Cl.[3] ..... B02C 13/18

[52] U.S. Cl. ..... 241/46.17; 241/60

[58] Field of Search ..... 241/28, 69, 46.08, 46.11, 241/46.17, 60, 46 B

[56] References Cited

U.S. PATENT DOCUMENTS

| | | | |
|---|---|---|---|
| 2,495,983 | 1/1950 | Richards | 241/46.11 X |
| 3,017,125 | 1/1962 | Sherman | 241/46.11 X |
| 3,713,595 | 1/1973 | Craig et al. | 241/46.17 X |
| 4,272,315 | 6/1981 | Espenmiller | 241/28 X |

*Primary Examiner*—Mark Rosenbaum

*Attorney, Agent, or Firm*—Albert L. Jeffers; John F. Hoffman

[57] ABSTRACT

An apparatus for dissolving pulp and producing a paper pulp suspension for use in papermaking. The apparatus comprises a container having a stirring rotor therein and, in the area of the lower wall of the container, an outlet chamber to which is connected a dilution water inlet pipe and an outlet pipe. A plate connected to the stirring elements defines the upper extremity of an outlet space and has a plurality of radial ribs connected thereto and extending downwardly into the outlet chamber. As the plate is rotated, the ribs cause mixing of the suspension which flows downwardly into the outlet chamber together with the dilution water to thereby produce a suspension having a lower consistency than the suspension within the container itself. In order to prevent dilution of the suspension within the main area of the container, a retaining wall is provided on the lower surface of the plate at a position radially outward of the axis of rotation. This wall substantially impedes the flow of the more dilute solution and water between the plate and wall of the container into the main portion of the container itself.

10 Claims, 2 Drawing Figures

PULP DISSOLVER FOR THE PRODUCTION OF PULP SUSPENSIONS

The present invention relates to an apparatus for dissolving pulp, and in particular to an apparatus for the production of paper pulp suspensions in papermaking processes.

Typically, the production of paper pulp suspensions is generally carried out by an apparatus comprising a container for containing a high consistency pulp suspension, a shaft member vertically disposed within the container and having stirring elements attached thereto, and a rotor plate attached to a lower portion of the stirring elements and having on its side opposite the stirring elements radially extending ribs. Below the plate is an outlet chamber communicating with the container through an opening and further having a water inlet pipe and outlet pipe connected thereto for providing water for the dilution of the pulp suspension.

In operation, as the stirring elements and rotor plate are rotated, pulp flows downwardly around the rotor plate into the outlet area above the outlet chamber for mixing by the ribs with the water. The dilution water tends to flow upwardly through the outlet area, outwardly along the rotor plate and into the main portion of the container thereby undesirably thinning the paper pulp suspension in the interior of the container. It is an object of the present invention to prevent this undesirable thinning of the higher consistency suspension within the main portion of the container, and confine the thinning operation to the outlet area beneath the rotor plate.

The present invention remedies the problem discussed above by providing an improved pulp dissolver which impedes the flow of water and the more dilute suspension past the rotor plate into the interior of the container itself. A retaining wall is provided on the same side of the rotor plate as the ribs and is spaced radially outward of the axis of rotation of the rotor plate, and may be interposed between the axis and the outer periphery of the plate. The effect of the retaining wall is to impede the flow of water past the rotor plate and into the main mixing area of the container, and to confine the mixing of the pulp and dilution water within the outlet area, primarily within the perimeter of the retaining wall. Because the retaining wall prevents the pulp in the interior of the container from becoming diluted, the stirring of the suspension and the dissolution of the pulp in the container may proceed at a high consistency, and the thinning is confined to the area of the outlet space.

In one embodiment of the invention, a truncated conically-shaped cover member is positioned over the retaining wall and between it and the outer periphery of the plate. In a modification, in place of the retaining wall, only the truncated conically-shaped cover member need be utilized. As the rotor plate rotates, the recess formed within the cover fills with pulp thereby causing the cover member to have the same effect as the retaining wall, that is, the impeding of the flow of the more dilute suspension into the main mixing area of the container.

In the broader aspects of this invention there is provided an improved pulp dissolver for the production of paper pulp suspensions comprising a container having side walls and a bottom wall with an opening therein, a shaft member generally vertically disposed through the opening in the bottom wall, a stirring element having a plurality of blades positioned in the lower portion of the container and attached to the shaft member, and a rotor plate attached to the bottom portion of the stirring element and having a periphery spaced slightly from a wall of the container and a plurality of elongated ribs on the side of the rotor plate opposite the stirring element. Also provided is an outlet chamber beneath the container and communicating with the container through an aperture therein. Water inlet and outlet pipes are connected to the outlet chamber. The improvement comprises a retaining wall projecting from the side of the rotor plate on which the ribs are located and spaced radially outward from the axis of rotation of the rotor plate.

It is an object of the present invention to provide a pulp dissolver for the production of paper pulp suspensions which impedes the flow of water to the interior of the container by means of a retaining wall on the side of the rotor plate on which the ribs are located.

It is another object of the present invention to provide a pulp dissolver for the production of paper pulp suspensions which yield pulp suspensions of the paper consistency by confining the mixing of the pulp and diluting water within the perimeter of the retaining wall.

BRIEF DESCRIPTION OF THE DRAWINGS

The above-mentioned and other features and objects of this invention, and the manner of attaining them will become more apparent and the invention itself will be better understood by reference to the following description of an embodiment of the invention taken in conjunction with the accompanying drawings, wherein.

DETAILED DESCRIPTION

Figure 1:
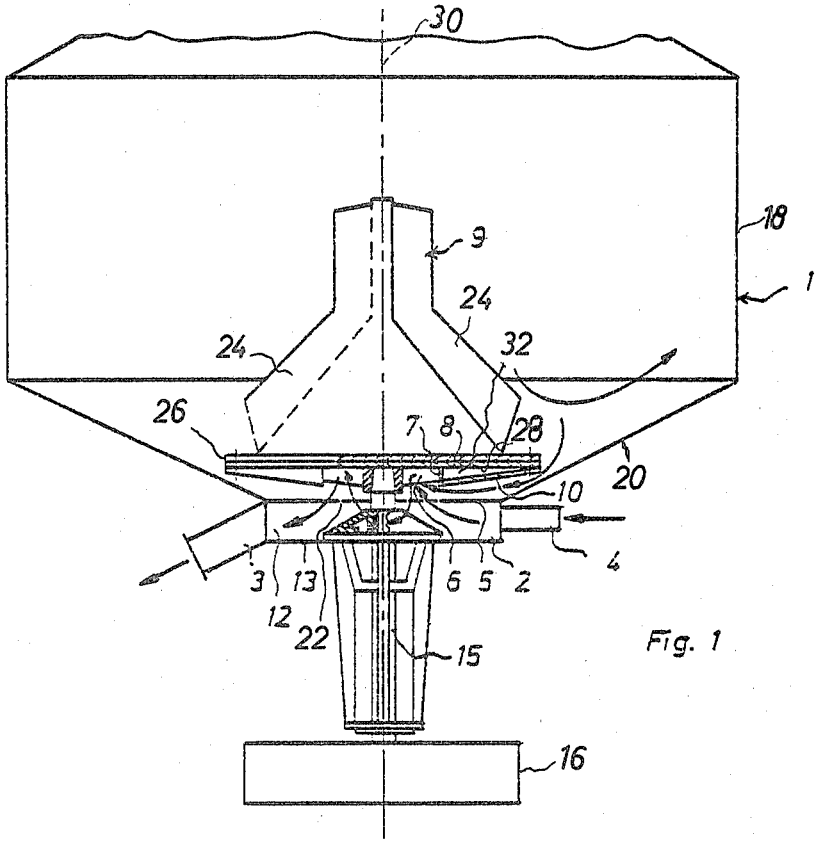
FIG. 1 is a sectional side view of one embodiment of the present invention.

Referring now to FIG. 1, the pulp dissolving apparatus of the present invention comprises in greater part a container 1, a mixing rotor 9, a water inlet pipe 4, an outlet pipe 3, and a rotary drive 16. Container 1 comprises a side wall 18 and a bottom wall 20 having an openning 22 therein, the bottom wall 20 being tapered inwardly toward the opening 22.

Mixing rotor 9 comprises a shaft 15 connected to drive 16 and passing vertically through the opening 22 in the bottom wall 20 of container 1. Rotor 9 comprises a plurality of blades 24 and a plate 8 connected to the lower portion of the blades 24. Rotor plate 8 has its periphery 26 spaced slightly from the lower wall 20 of container 1.

Between plate 8 and chamber 2 is an outlet space 12 within which the pulp suspension that flows downwardly through the space between the periphery 26 of plate 8 and the bottom wall 20 of container 1 is mixed with diluting water flowing into space 12 from inlet pipe 4 through chamber 2 and opening 22. A plurality of radial ribs 6 are affixed to the lower surface 28 of rotor plate 8, and ribs 6 may extend to the outer periphery 26 of plate 8. Ribs 6, since they are fixed to plate 8, which is driven by rotating shaft 15, rotate about the axis 30 and function to mix the suspension of pulp within area 12 with the diluting water that flows upwardly through opening 22.

Ribs 6, in the embodiment of FIG. 1, terminate at a retaining wall 7 which is connected to the lower surface 28 of plate 8 and extends preferably perpendicularly therefrom. Retaining wall 7 may be ring-shaped and is preferably coaxial with the axis of rotation 30 of plate 8. A truncated conically-shaped cover member 10 covers the portion of the rotor plate 8 which is radially outward from retaining wall 7, and may be welded to retaining wall 7 and to the periphery 26 of plate 8.

Retaining wall 7 and cover member 10 serve to confine the intermixing and stirring effect of ribs 6 within the radial area inside retaining wall 7, and substantially impede the flow of the more dilute suspension upwardly past the periphery 26 of plate 8 and into the main mixing area of container 1. In other words, the mixing of the dilution water is confined generally to the outlet space 12, and causes the more dilute suspension to flow downwardly through opening 22 into chamber 2 and out outlet pipe 3 without mixing directly with the higher consistency suspension within container 1.

If desired, retaining wall 7 could be omitted because the recess 32 within the conical-shaped cover member 10 can function as a retaining member impeding the movement of the more dilute suspension beyond the outlet area 12. Since the recess 32 would become substantially filled with fibers over a period of time, it would have the same effect as retaining wall 7.

Figure 2:
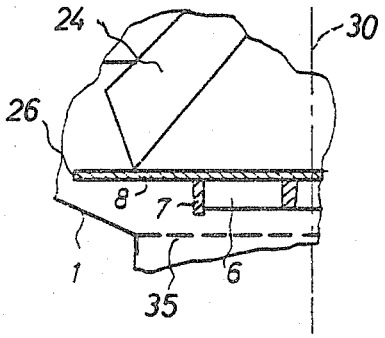
FIG. 2 is an enlarged, fragmentary, partially sectional view of another embodiment of the invention.

Referring now to FIG. 2, a somewhat modified form of the rotor is shown. In this modification, plate 8 carries only the retaining wall 7, and the cover member 10 is eliminated. If desired, ribs 6 could extend to the periphery 26 of plate 8, and the retaining wall 7 could be welded directly to the ribs 6, as in the form of a plurality of segments collectively extending around the periphery of plate 8. Furthermore, it is possible to form the stirring rotor 9 as a single casting such that the retaining wall 7 and cover member 10 and rotor plate 8 are essentially integral. In the case of the embodiment of FIG. 1, if the rotor assembly 9 were formed in this manner, the portion of plate 8 radially outward of retaining wall 7 could be cast as a truncated cone.

In the embodiment of FIG. 1, a strainer 5 is provided in the opening 22 between chamber 2 and the outlet area 12, running essentially parallel to the rotor plate 8, and having perforations only in the central area of the outlet space 12 to the extent that the ribs 6 extend. This arrangement enables the strainer to be continuously flushed with water thereby avoiding clogging of it. In FIG. 2, the strainer 35 has perforations extending radially beyond retaining wall 7.

While this invention has been described as having a preferred design, it will be understood that it is capable of further modification. This application is, therefore, intended to cover any variations, uses, or adaptations of the invention following the general principles thereof and including such deparatures from the present disclosure as come within known or customary practice in the art to which this invention pertains and fall within the limits of the appended claims.

What is claimed is:

1. A pulp dissolver for the production of paper pulp suspension comprising:

a container having side walls and a bottom wall with an opening therein, a shaft member generally vertically disposed through said opening, a stirring element positioned in the lower portion of said container and attached to said shaft member, a rotor plate attached to a bottom portion of said stirring element and having a periphery spaced slightly from a wall of said container, said rotor plate further having a plurality of elongated ribs on the side of said rotor plate opposite said stirring element, said ribs each having a radial component, an outlet chamber below said bottom wall, said outlet chamber communicating with said container through said opening in said bottom wall, a water inlet pipe connected to said outlet chamber, an outlet pipe connected to said outlet chamber, a retaining wall projecting from said opposite side of said rotor plate, said retaining wall being positioned generally radially outward of the axis of rotation of said rotor plate, said retaining wall substantially restricting the mixing of pulp and water by said ribs to the central portion of said rotor plate, and means for rotating said shaft member.

2. The pulp dissolver of claim 1 wherein said retaining wall is circular.

3. The pulp dissolver of claim 1 wherein said ribs are radial and terminate at said retaining wall, and said ribs and retaining wall are substantially the same height.

4. The pulp dissolver of claim 1 wherein said ribs terminate at said retaining wall.

5. The pulp dissolver of claim 1 wherein said retaining wall projects perpendicularly from said rotor blade a distance approximately the same as said ribs.

6. The pulp dissolver of claim 1 wherein said retaining wall is an annular member made of wood.

7. The pulp dissolver of claim 1 further including a truncated, conically-shaped cover member extending from said retaining wall to the periphery of said rotor plate.

8. The pulp dissolver of claim 1 further including a strainer disposed in said opening of said bottom wall.

9. A pulp dissolver for the production of paper pulp suspension comprising:

a container having side walls and a bottom wall with an opening therein, a shaft member generally vertically disposed through said opening, a stirring element positioned in the lower portion of said container and attached to said shaft member, said stirring element having a plurality of blades thereon, a rotor blade attached to a bottom portion of said stirring element and having a periphery spaced slightly from a wall of said container, said rotor blade further having a plurality of elongated ribs on the side of said rotor blade opposite said stirring element, said ribs each having a radial component, an outlet chamber below said bottom wall, said outlet chamber communicating with said container through said opening in said bottom wall, a water inlet pipe connected to said outlet chamber, an outlet pipe connected to said outlet chamber, a truncated conically-shaped cover member attached to said opposite side of said rotor blade such that a recess is formed between said cover member and plate radially outward from the axis of rotation of said rotor blade, and means for rotating said shaft member.

10. The pulp dissolver of claim 9 further including a strainer disposed in the opening of said bottom wall.

* * * * *